US006439347B2

(12) United States Patent
Suga et al.

(10) Patent No.: US 6,439,347 B2
(45) Date of Patent: Aug. 27, 2002

(54) ELEVATOR CONTROL APPARATUS CONTROLLING CHARGING OF A POWER SOURCE WITH REGENERATIVE POWER

(75) Inventors: Ikuro Suga; Hiroshi Araki; Shinobu Tajima; Kazuyuki Kobayashi, all of Tokyo (JP)

(73) Assignees: Mitsubishi Denki Kabushiki Kaisha; The Tokyo Electric Power Company, Inc, both of Tokyo (JP)

( * ) Notice: Subject to any disclaimer, the term of this patent is extended or adjusted under 35 U.S.C. 154(b) by 0 days.

(21) Appl. No.: 09/771,931

(22) Filed: Jan. 30, 2001

(30) Foreign Application Priority Data

Feb. 28, 2000 (JP) ..... 2000-051941

(51) Int. Cl.[7] ..... B66B 1/06

(52) U.S. Cl. ..... 187/290; 187/296; 318/376; 318/801

(58) Field of Search ..... 187/247, 290, 187/293, 296, 297; 318/375, 376, 377, 743, 727, 759, 798–815; 320/109, 121, 153

(56) References Cited

U.S. PATENT DOCUMENTS 4,456,097 A * 6/1984 Salihi ..... 187/29 R
4,554,999 A * 11/1985 Kamike ..... 187/29 R
5,285,029 A * 2/1994 Araki ..... 187/114
5,420,491 A * 5/1995 Kanzaki et al. ..... 318/727
5,712,456 A 1/1998 McCarthy et al.
5,936,375 A 8/1999 Enoki
6,315,081 B1 * 11/2001 Yeo ..... 187/290

FOREIGN PATENT DOCUMENTS

| | | |
|---|---|---|
| JP | 61-267675 | 11/1986 |
| JP | 7-242376 | 9/1995 |
| JP | 7-252040 | 10/1995 |
| JP | 10-67469 | 3/1998 |
| JP | 11-217193 | 8/1999 |
| JP | 11-299275 | 10/1999 |

* cited by examiner

*Primary Examiner*—Jonathan Salata
(74) *Attorney, Agent, or Firm*—Leydig Voit & Mayer, Ltd

(57) ABSTRACT

An elevator control apparatus includes: a converter for rectifying AC power into DC power; an inverter for converting the DC power into AC power having a variable voltage and a variable frequency; a controller for controlling a motor based on the AC power having the variable voltage and the variable frequency, operating an elevator; a power storage unit for storing the DC power; a required power computing circuit for computing required power of the elevator based on a speed command of the controller; a charge/discharge control circuit for issuing a drive signal for changing charge current, supplied to the power storage unit, based on regenerative electric power so as to charge the power storage unit with the regenerative electric power if the required power of the elevator is negative, meaning that the regenerative electric power is available; and a charge/discharge circuit for charging the power storage unit with the regenerative electric power in accordance with the drive signal. Thus, regenerative electric power can be effectively used, contributing to energy savings.

4 Claims, 19 Drawing Sheets

ELEVATOR CONTROL APPARATUS CONTROLLING CHARGING OF A POWER SOURCE WITH REGENERATIVE POWER

BACKGROUND OF THE INVENTION

1. Field of the Invention

The present invention relates to an elevator control apparatus utilizing a power storage unit.

2. Description of the Related Art

A conventional elevator control apparatus will be described with reference to an accompanying drawing. FIG. 19 shows a construction of a conventional elevator control apparatus disclosed, for example, under a title of "Redesigned medium-to-low speed passenger elevator, Grandy" on page 9 of Mitsubishi Denki Giho (written by Ando, Kimura, and Mori, Vol. 70, No. 11 issued in 1996).

The conventional elevator control apparatus shown in FIG. 19 includes a commercial three-phase AC power source 1, a motor 2, such as an induction motor IM, a hoisting machine 3, a rope 4, an elevator car 5, a counterweight 6, an encoder 7, a controller 8, a converter 9 formed of a diode or the like, a capacitor 10, a current detector 11, such as a current transformer (CT), an inverter 12, an inverter control circuit 13, a gate drive circuit 14, a regenerative resistor 15, and a switching means 16, such as an IGBT.

An operation of the aforesaid conventional elevator control apparatus will now be described with reference to the drawing.

The hoisting machine 3 is driven by the motor 2 to move the elevator car 5 and the counterweight 6 connected to both ends of the rope 4, thereby carrying passengers in the car to a predetermined floor.

The converter 9 rectifies AC power supplied from the commercial power source 1 to convert it into DC power, which is stored in the capacitor 10. The DC power is converted into AC power of a variable voltage and a variable frequency by the inverter 12.

The controller 8 controls starts and stops of the elevator and also creates commands regarding start and stop positions and speed. Based on a speed command supplied by the controller 8, the inverter control circuit 13 rotationally drives the motor 2 by reflecting current feedback from the current detector 11 and speed feedback from the encoder 7 mounted on the hoisting machine 3, thereby implementing the position and speed control of the elevator. At this time, the inverter control circuit 13 controls output voltages and frequencies of the inverter 12 via the gate drive circuit 14.

The counterweight 6 of the elevator is set such that it is balanced when the car 5 is loaded with a moderate number of passengers. For example, when the elevator travels in a balanced state, it is possible to increase the speed of the elevator while consuming electric power in an acceleration mode, and to turn accumulated speed energy back into electric power in a deceleration mode. In typical elevators, however, the regenerative electric power is consumed by being converted into heat energy by the regenerative resistor 15 by controlling the switching means 16.

The conventional elevator control apparatus described above operates the elevator by constantly supplying electric power from the commercial power source. This has been posing a problem in that the electric power generated during a regenerative mode of the elevator is thermally consumed mainly by the regenerative resistor rather than being effectively used.

SUMMARY OF THE INVENTION

The present invention has been made with a view toward solving the foregoing problem, and it is an object of the present invention to provide an elevator control apparatus that permits energy saving by effectively utilizing electric power generated during a regenerative mode of an elevator.

To this end, according to one aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a required power computing circuit for computing required power of the elevator based on a speed command of the controller; a charge/discharge control circuit which conducts control by changing charge current, which is to be supplied to the power storage unit, based on regenerative electric power, and issues a drive signal for charging the power storage unit with the regenerative electric power if required power of the elevator is negative, that is, if the regenerative electric power is available; and a charge/discharge circuit for charging the power storage unit with the regenerative electric power in accordance with the drive signal.

According to another aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a required power computing circuit for computing required power of the elevator based on a speed command of the controller; a charge/discharge control circuit which carries out control such that a bus voltage between the converter and the inverter stays constant at a preset voltage that is not less than a voltage obtained by rectifying the AC power, and issues a drive signal for charging the power storage unit with the regenerative electric power if required power of the elevator is negative, that is, if the regenerative electric power is available; and a charge/discharge circuit for charging the power storage unit with the regenerative electric power in accordance with the drive signal.

According to yet another aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a required power computing circuit for computing required power of the elevator based on a speed command of the controller and issuing a regenerative operation signal if the required power is negative; a charge/discharge control circuit that starts charge control of regenerative electric power and issues a drive signal for charging the power storage unit with the regenerative electric power upon receipt of the regenerative operation signal; and a charge/discharge circuit for starting charging the power storage unit with the regenerative electric power in accordance with the drive signal.

According to still another aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit that stops charge control of regenerative electric power and issues a drive signal for stopping charging the power storage unit with the regenerative electric power upon receipt of an elevator stop signal from the controller; and a charge/discharge circuit for stopping charging the power storage unit with the regenerative electric power in accordance with the drive signal.

According to a further aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit that starts charge control of regenerative electric power and issues a drive signal for charging the power storage unit with the regenerative electric power when a bus voltage between the converter and the inverter reaches a preset predetermined voltage that is higher than a voltage obtained by rectifying the AC power; and a charge/discharge circuit for starting charging the power storage unit with the regenerative electric power in accordance with the drive signal.

According to a further aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit that carries out control such that a bus voltage between the converter and the inverter stays constant at a present voltage that is not less than a voltage obtained by rectifying the AC power, and stops the charge control of regenerative electric power and issues a drive signal for stopping charging the power storage unit with the regenerative electric power when charge current is controlled until it reaches zero; and a charge/discharge circuit for stopping charging the power storage unit with the regenerative electric power in accordance with the drive signal.

According to another aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit that controls a charge current supplied to the power storage unit at a constant present predetermined current value and issues a drive signal for charging the power storage unit with the regenerative electric power at the constant current; and a charge/discharge circuit for charging the power storage unit with the regenerative electric power in accordance with the drive signal.

According to a further aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit that stops charge control of regenerative electric power and issues a drive signal for stopping charging the power storage unit with the regenerative electric power when a bus voltage between the converter and the inverter reaches a preset predetermined voltage that is higher than a voltage obtained by rectifying the AC power; and a charge/discharge circuit for stopping charging the power storage unit with the regenerative electric power in accordance with the drive signal.

According to another aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit that controls charge current supplied to the power storage unit at a plurality of present predetermined constant current values in steps based on the bus voltage between the converter and the inverter, and issues a drive signal for charging the power storage unit with regenerative electric power at constant current; and a charge/discharge circuit for charging the power storage unit with the regenerative electric power in accordance with the drive signal.

According to a further aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit which carries out control such that a bus voltage between the converter and the inverter stays constant at a preset predetermined voltage and that, when charge current supplied to the power storage unit reaches a preset predetermined upper limit value, the charge current stays at the upper limit value, and issues a drive signal for charging the power storage device with regenerative electric power; and a charge/discharge circuit for charging the power storage unit with the regenerative electric power in accordance with the drive signal.

In a preferred form of the invention, when the charge current supplied to the power storage unit reaches the predetermined upper limited value, and if the bus voltage exceeds a preset second predetermined voltage while charging the power storage unit at the upper limit value is being continued, then the charge/discharge control circuit causes a part of the regenerative electric power to be thermally consumed by a resistor.

According to a further aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit which carries out control such that a bus voltage between the converter and the inverter stays constant at a preset predetermined voltage, issues a first drive signal for charging the power storage unit with the regenerative electric power control, and stops charge control of the regenerative electric power and issues a second drive signal for stopping charging the power storage unit with the regenerative electric power when a voltage of the power storage unit reaches a preset predetermined upper limit value; and a charge/discharge circuit for charging the power storage unit with the regenerative electric power in accordance with the first drive signal and for stopping charging the power storage unit with the regenerative electric power in accordance with the second drive signal.

According to another aspect of the present invention, there is provided an elevator control apparatus including: a converter for rectifying AC power into DC power; an inverter for converting the DC power into AC power of a variable voltage and a variable frequency; a controller for controlling a motor based on the AC power of the variable voltage and the variable frequency so as to operate an elevator; a power storage unit for storing the DC power; a charge/discharge control circuit which carries out control such that a bus voltage between the converter and the inverter stays constant at a preset predetermined voltage, issues a drive signal for charging the power storage unit with regenerative electric power, and carries out control such that the charge current supplied to the power storage unit reaches a predetermined upper limit value and issues a drive signal for charging the power storage unit with regenerative electric power when a voltage of the power storage unit reaches a preset predetermined voltage; and a charge/discharge circuit for charging the power storage unit with the regenerative electric power in accordance with the drive signals.

In a preferred form of the invention, when the voltage of the power storage unit reaches the preset predetermined voltage, and if the bus voltage exceeds a preset second predetermined voltage while charging the power storage unit at the upper limit value is being continued, then the charge/discharge control circuit causes a part of the regenerative electric power to be thermally consumed by a resistor.

DESCRIPTION OF THE PREFERRED EMBODIMENTS

First Embodiment

Figure 1:
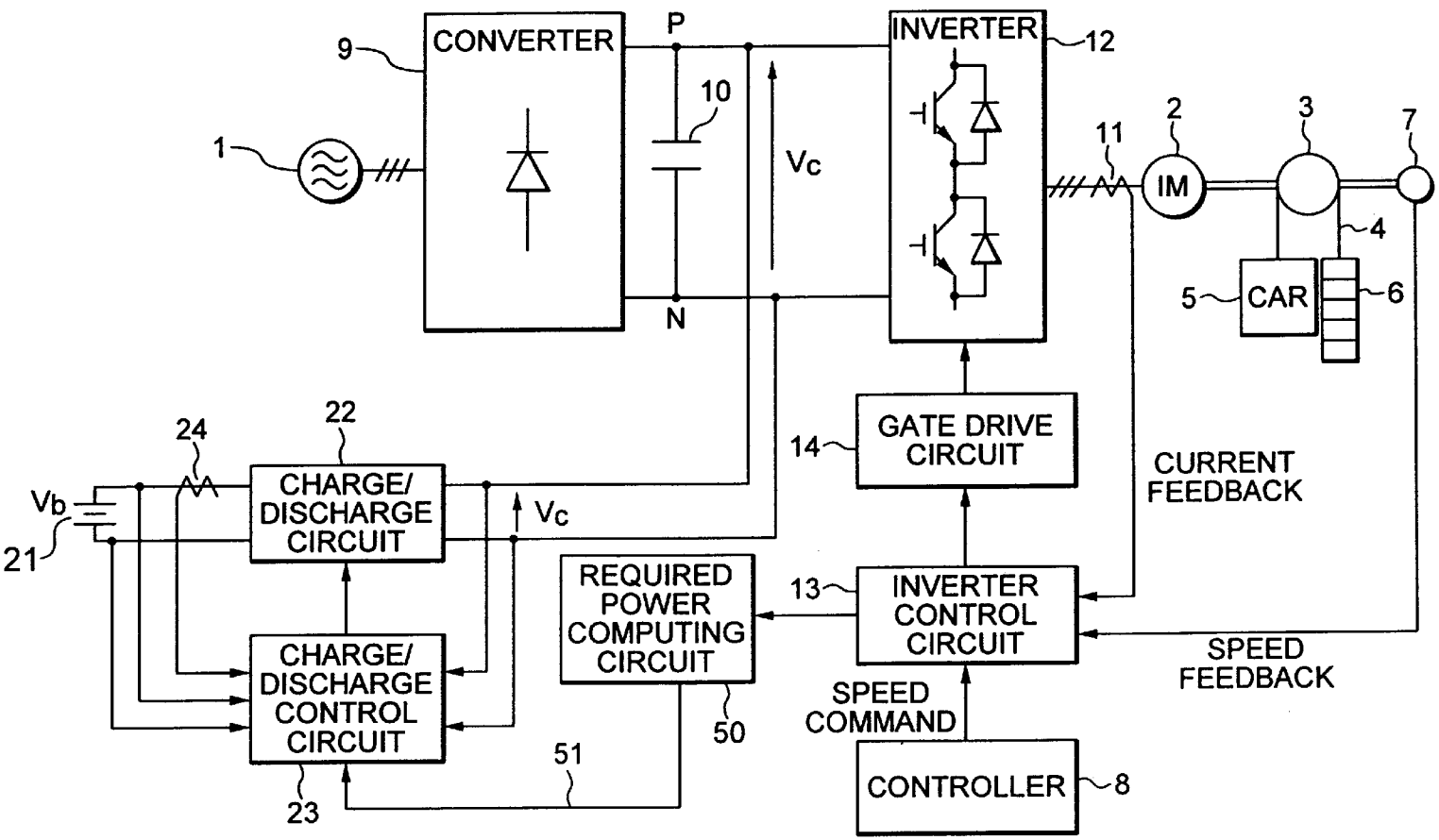
FIG. 1 is a block diagram showing a construction of an elevator control apparatus according to a first embodiment of the present invention.

An elevator control apparatus according to a first embodiment of the present invention will be described in conjunction with the accompanying drawings. FIG. 1 is a diagram showing a construction of the elevator control apparatus according to the first embodiment of the present invention. In the drawings, the like reference numerals will denote like or equivalent components.

Figure 19:
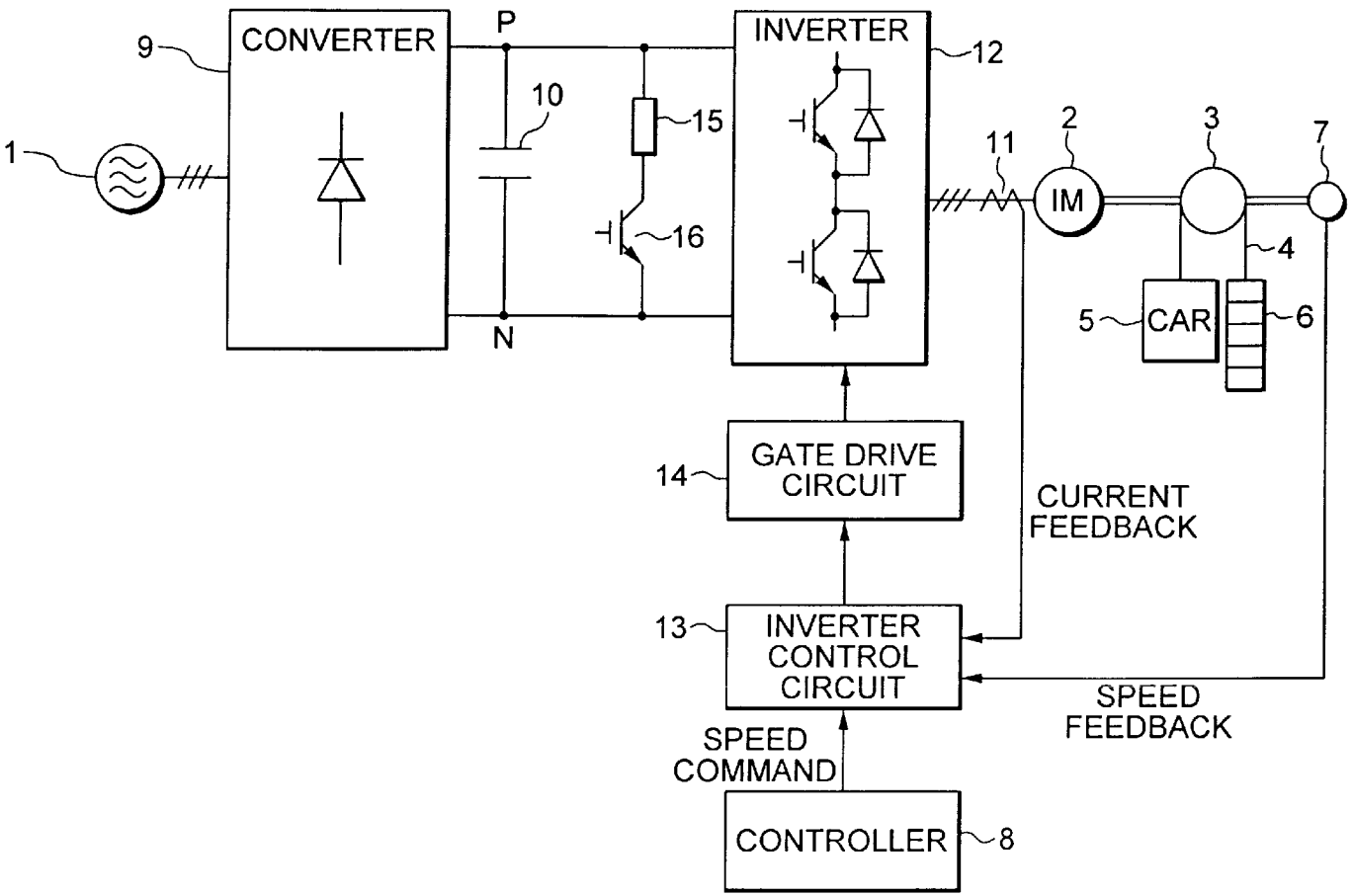
FIG. 19 PRIOR ART
FIG. 19 is a diagram showing a construction of a conventional elevator control apparatus.

A three-phase AC power source 1 through a gate drive circuit 14 in FIG. 1 are equivalent to the like components of FIG. 19 described in the foregoing conventional example.

The elevator control apparatus shown in FIG. 1 further includes a power storage unit 21 composed of a battery, a charge/discharge circuit 22 composed of a DC/DC converter or the like, a charge/discharge control circuit 23 for controlling charging and discharging power of the charge/discharge circuit 22, a current detector 24 which is composed of a current transformer (CT) or the like and which detects an input/output current of the power storage unit 21, a required power computing circuit 50 for computing required power of an elevator, and a communication cable 51 for transmitting a signal indicating the required power computed by the required power computing circuit 50.

Figure 2:
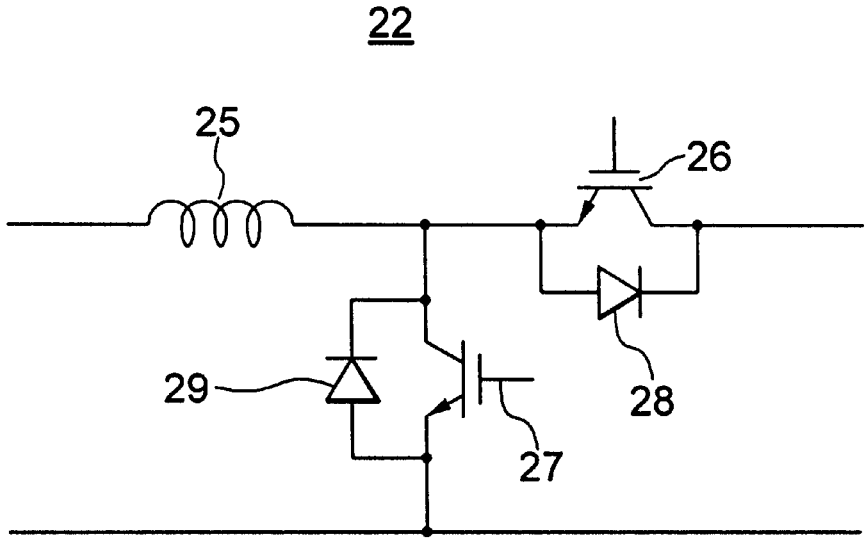
FIG. 2 is a circuit diagram showing a configuration of a charge/discharge circuit of the elevator control apparatus according to the first embodiment of the present invention.

FIG. 2 is a circuit diagram showing a configuration of the charge/discharge circuit. Referring to FIG. 2, reference numeral 25 denotes a reactor, a reference numerals 26 and 27 denote switching devices, such as IGBTs or the like, and reference numerals 28 and 29 denote diodes that are connected inversely in parallel.

The power storage unit 21 is charged by a step-down chopper circuit formed by the switching device 26 and the diode 29. Discharging from the power storage unit 21 is performed by a step-up chopper circuit formed by the switching device 27 and the diode 28.

Figure 3:
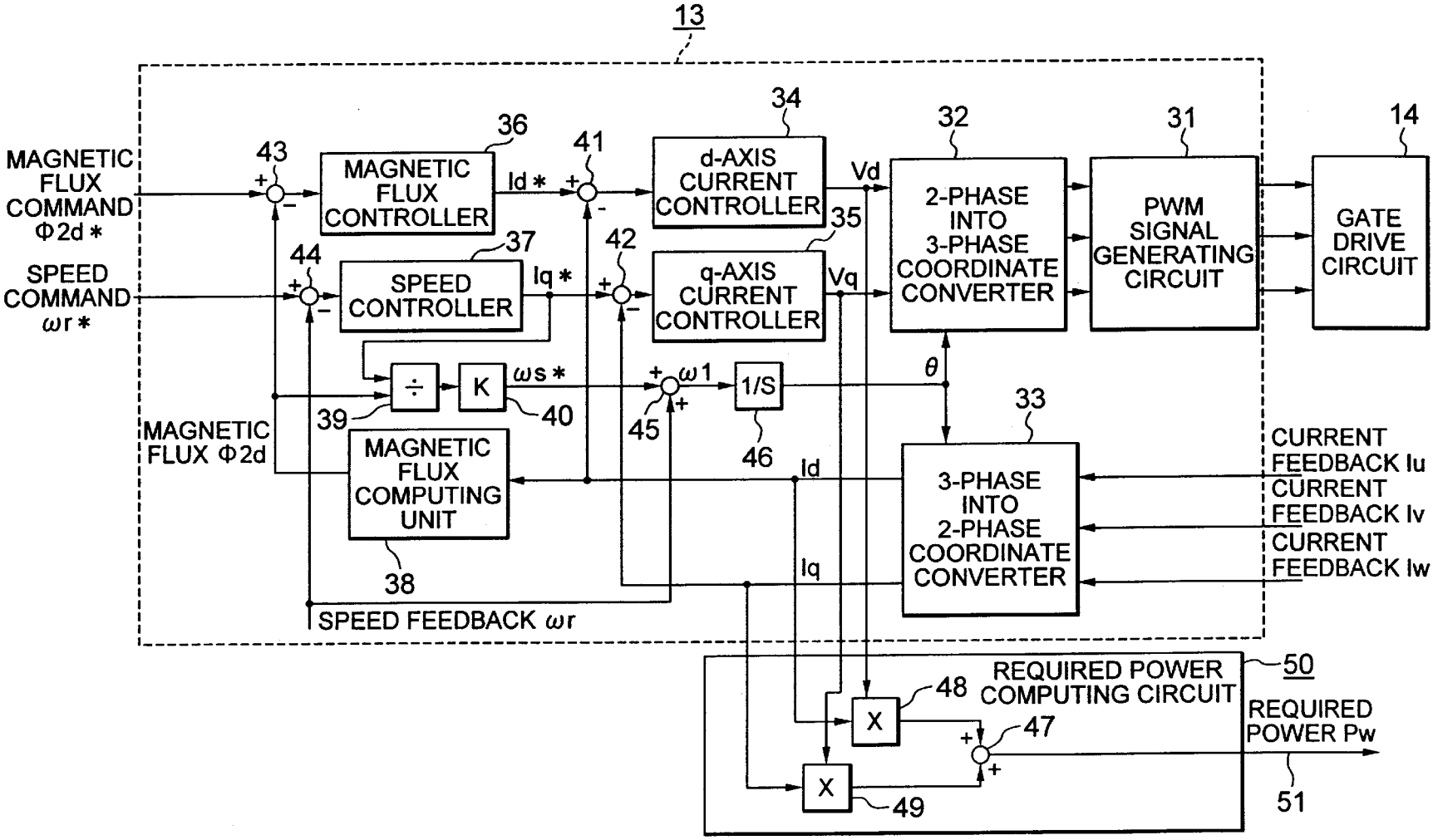
FIG. 3 is a circuit diagram showing a configuration of an inverter control circuit and a configuration of a required power computing circuit of the elevator control apparatus according to the first embodiment of the present invention.

FIG. 3 is a block diagram showing the configurations of an inverter control circuit and a required power computing circuit shown in FIG. 1. Referring to FIG. 3, a three-phase into two-phase coordinate converter 33 converts three-phase AC currents Iu, Iv, and Iw into values on a two-axis rotating coordinate system (d-q coordinate system) that rotates in synchronization with a frequency ωl of an AC voltage applied to a stator winding, i.e. stator winding currents Id and Iq. A magnetic flux computing device 38 calculates a magnetic flux Φ2d interlinking a rotor from the stator winding current Id on the d-q coordinate system.

FIG. 3 further shows a PWM signal generating circuit 31, a two-phase into three-phase coordinate converter 32 for converting voltage command values Vd and Vq on the d-q coordinate system into three-phase AC voltage command values, a d-axis current controller 34 that performs, for example, a proportional integral operation on a difference between a d-axis component command value Id* of a stator winding current and its actual value Id thereby to control a d-axis current to a command value, and a q-axis current controller 35 that also performs, for example, the proportional integral operation on a difference between a q-axis component command value Iq* of a stator winding current and its actual value Iq thereby to control a q-axis current to a command value.

FIG. 3 further shows a magnetic flux controller 36 for controlling a d-axis component Φ2d of a rotor winding interlinking magnetic flux to a desired value Φ2d*, a velocity controller 37 for controlling a rotor angular velocity ωr to a desired value ωr*, a dividing device 39, and a coefficient device 40. A slip frequency command ωs* is calculated by the dividing device 39 and the coefficient device 40.

In FIG. 3, reference numerals 41, 42, 43, 44, and 45 denote adders or subtractors. Reference numeral 46 denotes an integrator.

In the drawing, reference numeral 47 denotes an adder, reference numerals 48 and 49 denote integrators, and reference numeral 50 denotes a required power computing device. A product of a voltage command value Vd and a stator winding current Id on the d-q coordinate system and a product of a voltage command value Vq and a stator winding current Iq are added to compute required power Pw of an elevator.

The required power computing device 50 is able to perform a similar computation to the above computation by adding a product of the voltage command value Vd and a stator winding current command value Id* on the d-q coordinate system and a product of the voltage command value Vq and a stator winding current command value Iq*.

Lastly, an output three-phase AC voltage command value of the two-phase into three-phase coordinate converter 32 is sent to the PWM signal generating circuit 31, and the inverter 12 is driven by the gate drive circuit 14.

Figure 4:
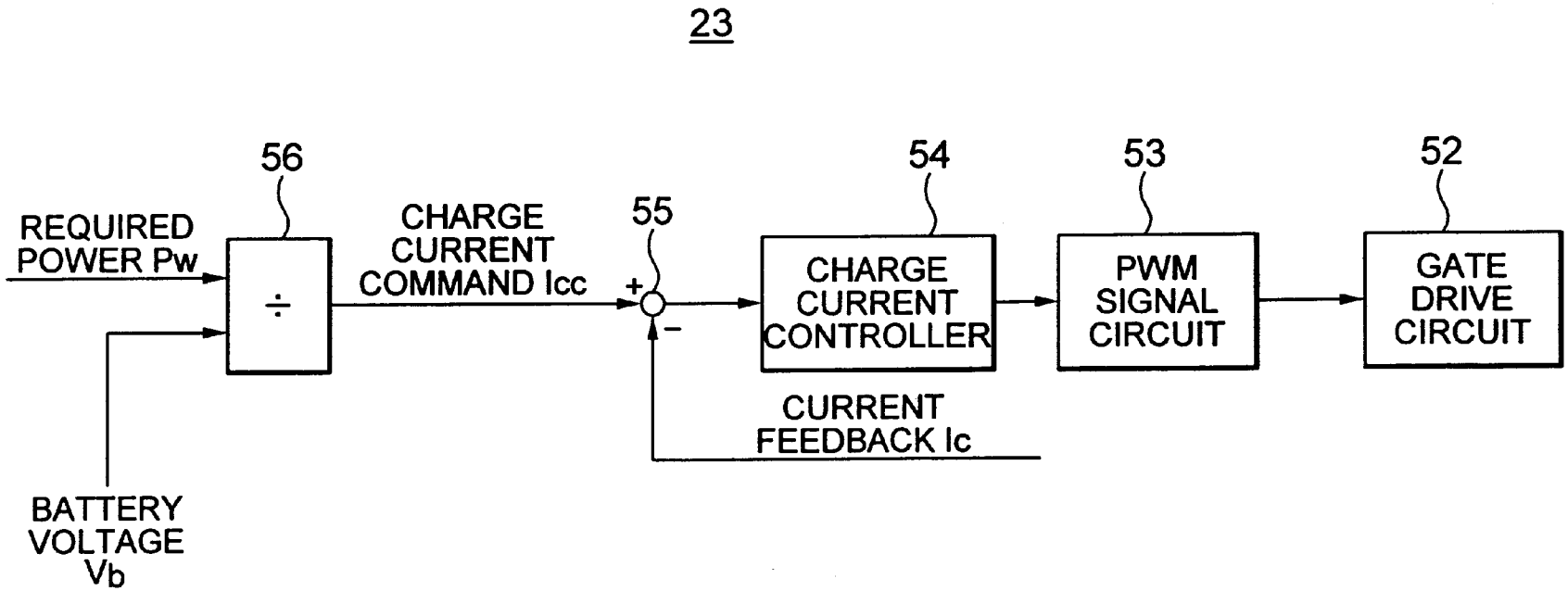
FIG. 4 is a circuit diagram showing a configuration of a charge/discharge control circuit of the elevator control apparatus according to the first embodiment of the present invention.

FIG. 4 is a block diagram showing a configuration of a charge control circuit of the charge/discharge control circuit of FIG. 1. Referring to FIG. 4, the charge control circuit includes a gate drive circuit 52, a PWM signal circuit 53 for generating a PWM modulation signal, and a charge current controller 54 that performs, for example, proportional integral operation on a difference between a charge current command value Icc and an actual value Ic of a charge current detected by the current detector 24 of FIG. 1, thereby controlling the charge current to the charge current command value. The charge control circuit further includes a subtractor 55 and a dividing device 56.

Figure 5:
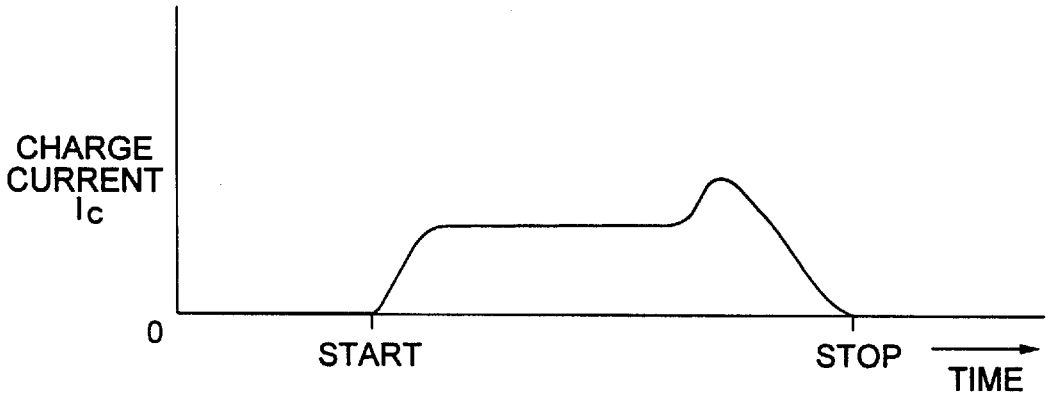
FIG. 5 is a diagram showing a charge current waveform of the elevator control apparatus according to the first embodiment of the present invention.

An operation of the elevator control apparatus according to the first embodiment will now be described with reference to the accompanying drawings. FIG. 5 shows a charge current waveform of the elevator control apparatus according to the first embodiment of the present invention.

The elevator travels according to a predetermined speed command issued by the inverter control circuit 13 shown in FIG. 1. At the same time, the required power computing circuit 50 computes the required power Pw of the elevator, and the computed required power Pw is output to the charge/discharge control circuit 23 via the communication cable 51.

Based on the required power Pw, the charge control circuit of the charge/discharge control circuit 23 shown in FIG. 4 charges the power storage unit 21 with the power regenerated by the elevator by actuating the control circuit 22 for charging power shown in FIG. 2 during a regenerative mode of the elevator, that is, if the required power is negative.

The charging control circuit of the charge/discharge control circuit 23 uses the required power Pw computed by the required power computing circuit 50 and a battery voltage Vb to create the charge current command Icc according to the following expression (1):

$$Icc=Pw/Vb \tag{1}$$

Then, based on the charge current command Icc and the charge current Ic, the charge current controller 54 carries out control by changing the charge current as shown in FIG. 5.

The regenerative electric power charged to the power storage unit 21 is discharged as necessary by the discharge circuit of the charge/discharge circuit 22 shown in FIG. 2 and used to drive the elevator.

Thus, in the regenerative mode, that is, if the required power is negative, the power storage unit 21 is charged with regenerative electric power, and the regenerative electric power charged to the power storage unit is discharged as necessary. With this arrangement, effective utilization of regenerative electric power can be achieved, and power supplied from the commercial power source 1 can be reduced, permitting energy saving.

Second Embodiment

An elevator control apparatus according to a second embodiment of the present invention will be described with reference to the accompanying drawings.

In the foregoing first embodiment, a case has been described wherein the charge current supplied to the power storage unit 21 is controlled if the required power Pw computed by the required power computing circuit 50 is negative. The second embodiment controls a voltage between P and N shown in FIG. 1, i.e. a bus voltage Vc, to a constant voltage in charging the power storage unit 21. The second embodiment also provides the same advantages as those of the first embodiment.

The required power computing circuit 50 incurs some error in computing regenerative electric power due to mechanical or electrical losses or the like. For this reason, the bus voltage decreases if a computer value is larger than actual regenerative electric power, while the bus voltage increases if a computed value is smaller than actual regenerative electric power. Controlling the bus voltage Vc at a constant voltage allows the bus voltage to be maintained at a predetermined value, permitting the power storage unit 21 to be charged more accurately based on actual regenerative electric power.

Figure 6:
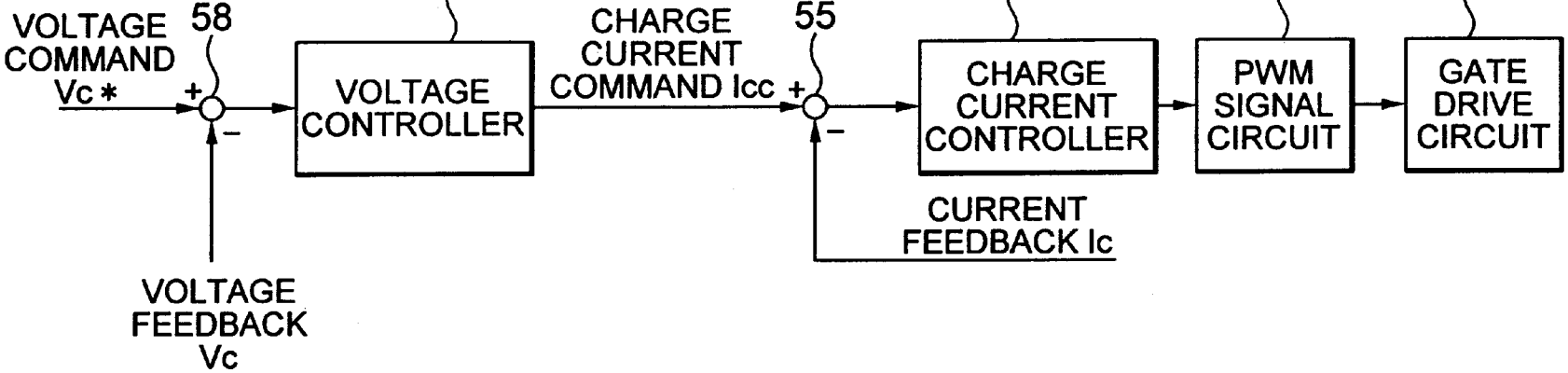
FIG. 6 is a circuit diagram showing a configuration of a charge/discharge control circuit of an elevator control apparatus according to a second embodiment of the present invention.

FIG. 6 is a block diagram showing a configuration of a charging control circuit of a charge/discharge control circuit of an elevator control apparatus according to the second embodiment of the present invention. The rest of the configuration is the same as the configuration of the first embodiment described above.

Referring to FIG. 6, reference numerals 52 through 55 denote the same components as those of the charging control circuit of FIG. 4 shown in the aforesaid first embodiment. Reference numeral 23A denotes a charge/discharge control circuit, reference numeral 57 denotes a voltage controller, and reference numeral 58 denotes a subtractor.

Figure 7:
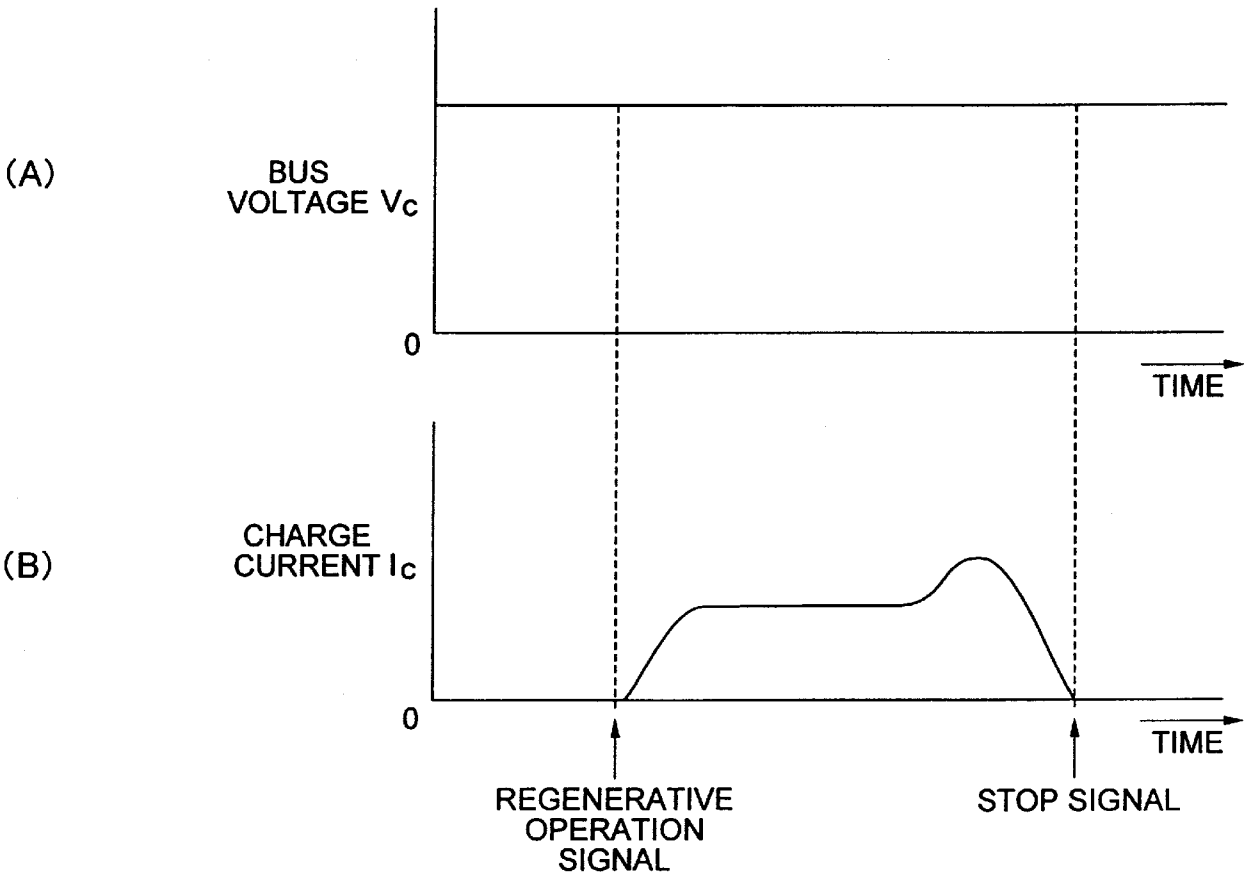
FIGS. 7(A) and 7(B) are timing charts illustrating an operation of the elevator control apparatus according to the second embodiment of the present invention.

An operation of the elevator control apparatus according to the second embodiment will now be described in conjunction with the accompanying drawings. FIGS. 7(A) and 7(B) are timing charts illustrating the operation of the elevator control apparatus according to the second embodiment of the present invention, wherein FIG. 7(A) shows a waveform of the bus voltage, and FIG. 7(B) shows a waveform of charge current.

The elevator travels according to a predetermined speed command issued by the inverter control circuit 13 shown in FIG. 3. At the same time, the required power computing circuit 50 shown in FIG. 1 computes the required power Pw of the elevator, and if the required power becomes negative, then a regenerative operation signal is output to a charge/discharge control circuit 23A via the communication cable 51.

Upon receipt of the regenerative operation signal of the elevator, the charging control of the charge/discharge control circuit 23A starts as illustrated in FIGS. 7(A) and 7(B) to charge the power storage unit 21 with the regenerative electric power of the elevator.

Based on a predetermined voltage command (a voltage not less than the voltage obtained by rectifying a supply voltage), a charging power control circuit in the charge/discharge control circuit 23A controls the voltage to a constant voltage by a voltage controller 57 as shown in FIG. 6. Furthermore, the charge current is controlled by a charge current controller 54 to precisely charge the power storage unit 21 with the regenerative electric power. To conduct the charging control of the charge/discharge control circuit 23A, an elevator stop signal is received from the controller 8 shown in FIG. 1 via a communication cable or the like (not shown in FIG. 1) so as to stop the elevator as shown in FIGS. 7(A) and 7(B).

Third Embodiment

An elevator control apparatus according to a third embodiment of the present invention will be described with reference to the accompanying drawings. The basic construction of the elevator control apparatus according to the third embodiment is identical to the construction of the foregoing first embodiment.

In the second embodiment described above, the control of charging the power storage unit 21 with regenerative electric power is begun upon receipt of the elevator regenerative operation signal. In the third embodiment, the control of charging the power storage unit 21 with regenerative electric power is begun from a moment a preset bus voltage is reached during a regenerative operation mode of the elevator. The preset bus voltage is higher than a voltage obtained by rectifying and smoothing a supply voltage. With this arrangement, the same advantages can be obtained, and the need for the communication cable 51 or the like can be obviated.

In the second embodiment, an elevator stop signal from the controller 8 is received via the communication cable or the like to stop the control of charging the power storage unit 21 with regenerative electric power. In the third embodiment, the charging control is stopped when charge current reaches zero. This arrangement enables the same advantages to be obtained and also obviates the need for a communication cable or the like.

Figure 8:
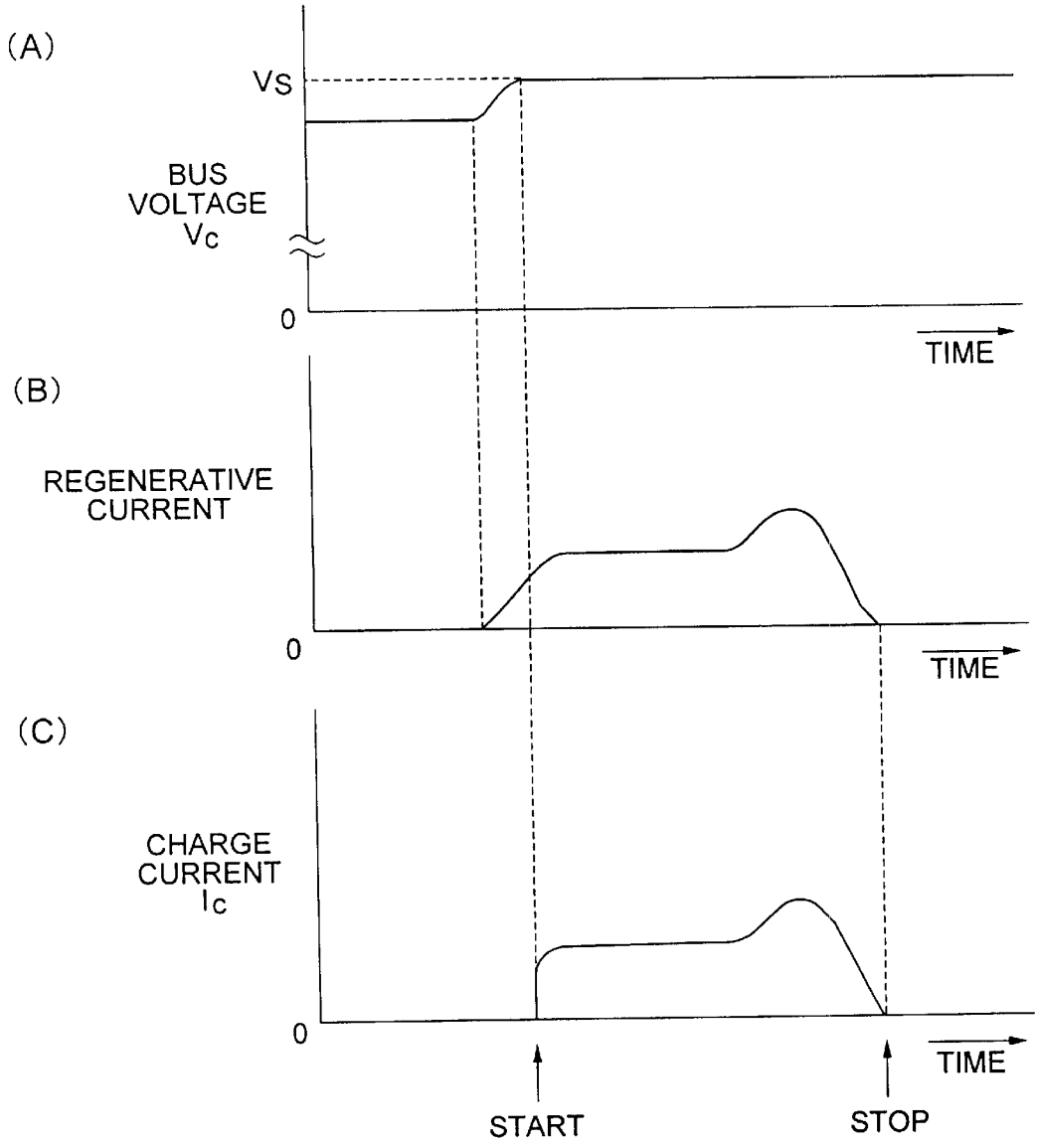
FIGS. 8(A)–8(C) are timing charts illustrating an operation of the elevator control apparatus according to a third embodiment of the present invention.

An operation of the third embodiment will now be described. FIGS. 8(A)–8(C) show waveforms related to the elevator control apparatus according to the third embodiment of the present invention, wherein FIG. 8(A) shows a bus voltage waveform, FIG. 8(B) shows a waveform of a regenerative current from a motor 2, and FIG. 8(C) shows a waveform of charge current supplied to the power storage unit 21.

When the elevator starts its regenerative operation, regenerative current is supplied to the capacitor 10 of FIG. 1 and the bus voltage increases as illustrated in FIG. 8(A). The control of charging the power storage unit 21 with regenerative electric power is started from the moment the bus voltage reaches a voltage Vs that has been preset at a voltage higher than a voltage obtained by rectifying and smoothing a supply voltage as shown in FIG. 8(C).

A charging power control circuit in a charge/discharge control circuit 23A controls the voltage to a constant voltage by a voltage controller 57 based on a predetermined voltage command (the same voltage as the voltage Vs at which the charging control is started in this embodiment), and the charge current is controlled by a charge current controller 54 as shown in FIG. 6, thereby precisely charging the power storage unit 21 with regenerative electric power.

The charging control by the charge/discharge control circuit 23A is stopped after the moment a charge current detected by a current detector 24 shown in FIG. 1 reaches zero.

Fourth Embodiment

An elevator control apparatus according to a fourth embodiment of the present invention will be described with reference to the accompanying drawings. The basic construction of the elevator control apparatus according to the fourth embodiment is identical to the construction of the foregoing first embodiment.

Figure 9:
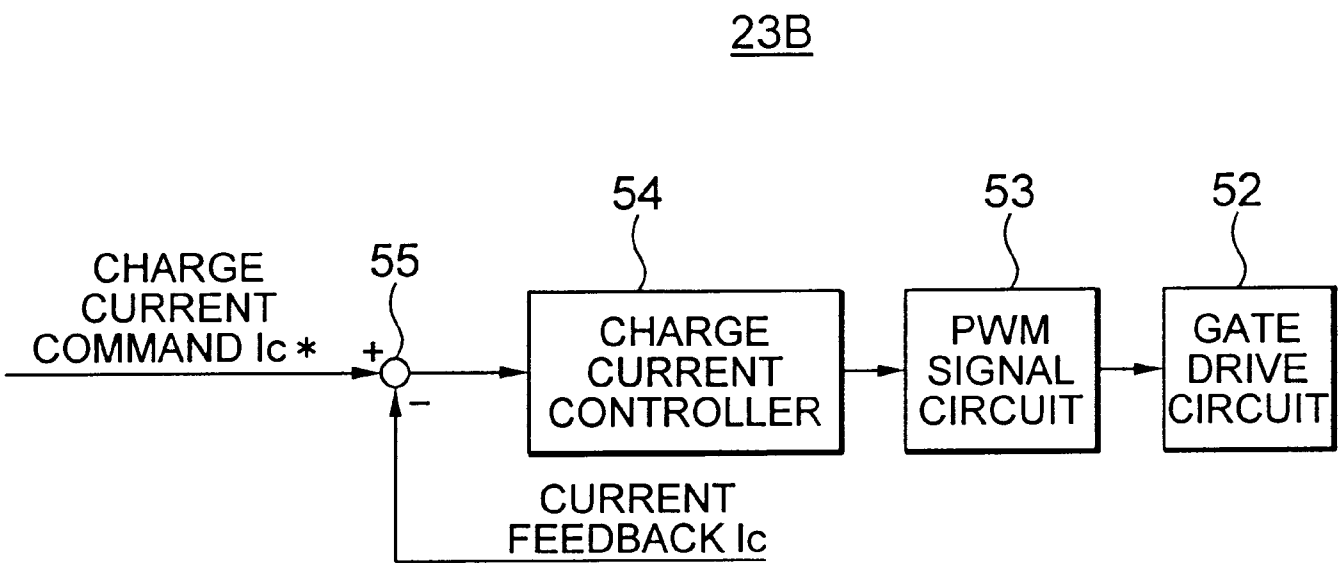
FIG. 9 is a circuit diagram showing a configuration of a charge/discharge control circuit of an elevator control apparatus according to a fourth embodiment of the present invention.

FIG. 9 is a block diagram showing a configuration of a charging control circuit in a charge/discharge control circuit of the elevator control apparatus according to the fourth embodiment of the present invention. Referring to FIG. 9, reference numeral 23B denotes a charge/discharge control circuit, and a gate drive circuit 52 through a subtractor 55 are equivalent to the components of the charging control circuit of FIG. 4 referred to in the first embodiment of FIG. 6 referred to in the second embodiment.

In the first through third embodiments described above, the charge current of regenerative electric power supplied to the power storage unit 21 is controlled by changing it. In the fourth embodiment, the charging is performed at a constant current, making it possible to provide the same advantages as those of the first embodiment and also to prevent a sudden increase in a battery voltage attributable to large-current charging in the vicinity of a peak of regenerative electric power taking place before an elevator is stopped when the power storage unit 21 employs a battery, and further to prevent a gas from being produced in the battery, thus protecting the battery from rapid deterioration.

Figure 10:
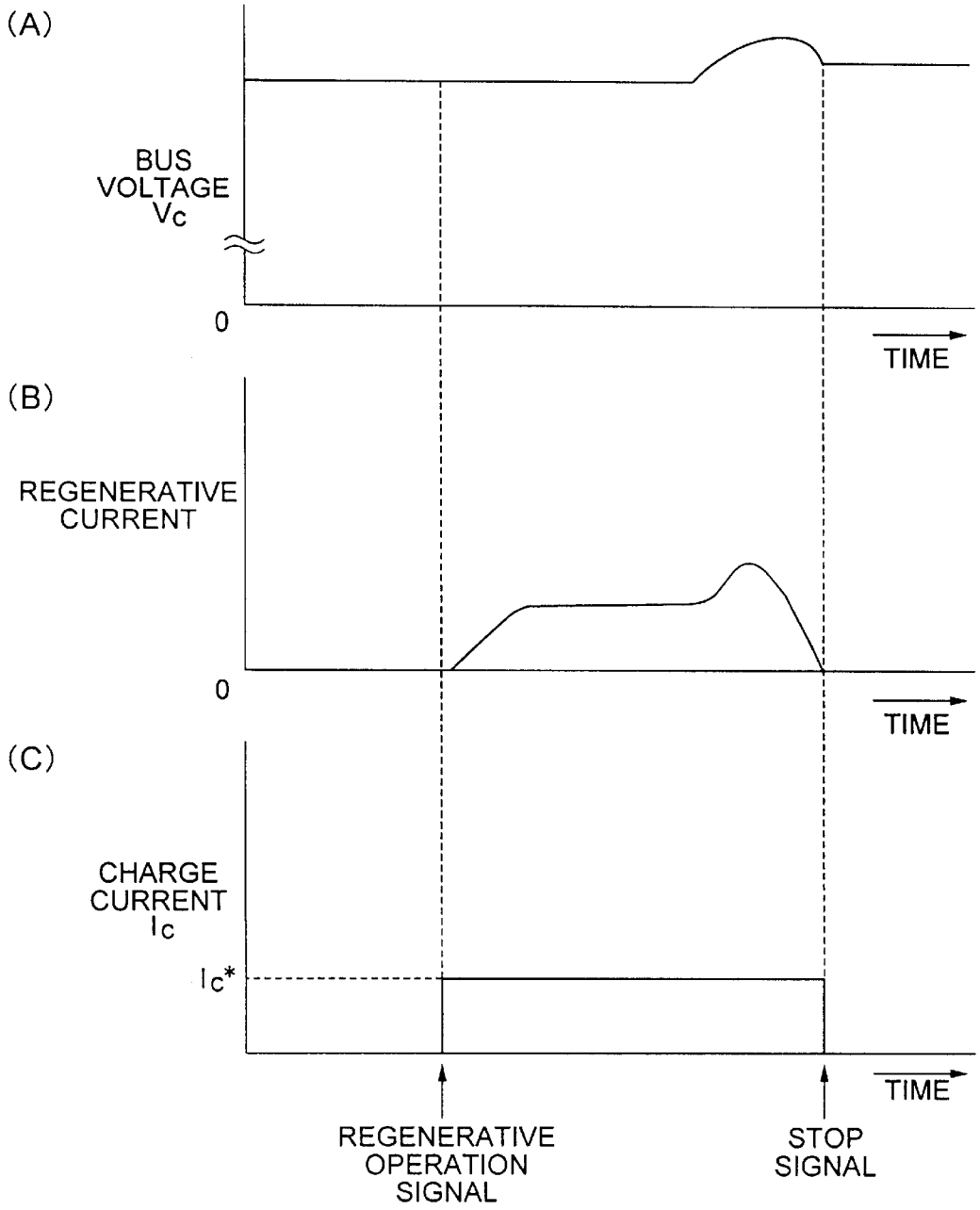
FIGS. 10(A)–10(C) are timing charts illustrating an operation of an elevator control apparatus according to a fourth embodiment of the present invention.

An operation of the fourth embodiment will now be described. FIGS. 10(A)–10(C) show waveforms related to the elevator control apparatus according to the fourth embodiment of the present invention, wherein FIG. 10(A) shows a bus voltage waveform, FIG. 10(B) shows a waveform of a regenerative current from a motor 2, and FIG. 10(C) shows a waveform of charge current supplied to the power storage unit 21.

Upon receipt of an elevator regenerative operation signal from the required power computing circuit 50 shown in FIG. 1 via the communication cable 51, the charge/discharge control circuit 23B performs charging at a constant current of a charge current command value Ic* as shown in FIG. 10(C).

As shown in FIG. 9, the current is controlled to the constant current by a charge current controller 54.

To carry out the charging control of the charge/discharge control circuit 23B, an elevator stop signal from the controller 8 shown in FIG. 1 is received via a communication cable or the like (not shown in FIG. 1), and the elevator is stopped as illustrated in FIG. 10(C).

Fifth Embodiment

An elevator control apparatus according to a fifth embodiment of the present invention will be described with reference to the accompanying drawings. The basic construction of the elevator control apparatus according to the fifth embodiment is identical to the construction of the foregoing first embodiment.

In the fourth embodiment described above, upon receipt of the elevator regenerative operation signal, the charging the power storage unit 21 is begun at a constant current, and the charging is stopped upon receipt of the elevator stop signal. In the fifth embodiment, control of charging the power storage unit 21 with regenerative electric power is begun at the moment a bus voltage, which is preset at a voltage higher than a voltage obtained by rectifying and smoothing a supply voltage, is reached, and the control of charging the power storage unit 21 with the regenerative electric power is stopped at the moment a preset but voltage is reached. The fifth embodiment provides the same advantages as those of the fourth embodiment described above, and also prevents the capacitor 10 from being charged with power supplied from the commercial power source 1 when there is more charge current than regenerative current, and prevents the bus voltage from markedly increasing when there is less charge current than regenerative current.

Figure 11:
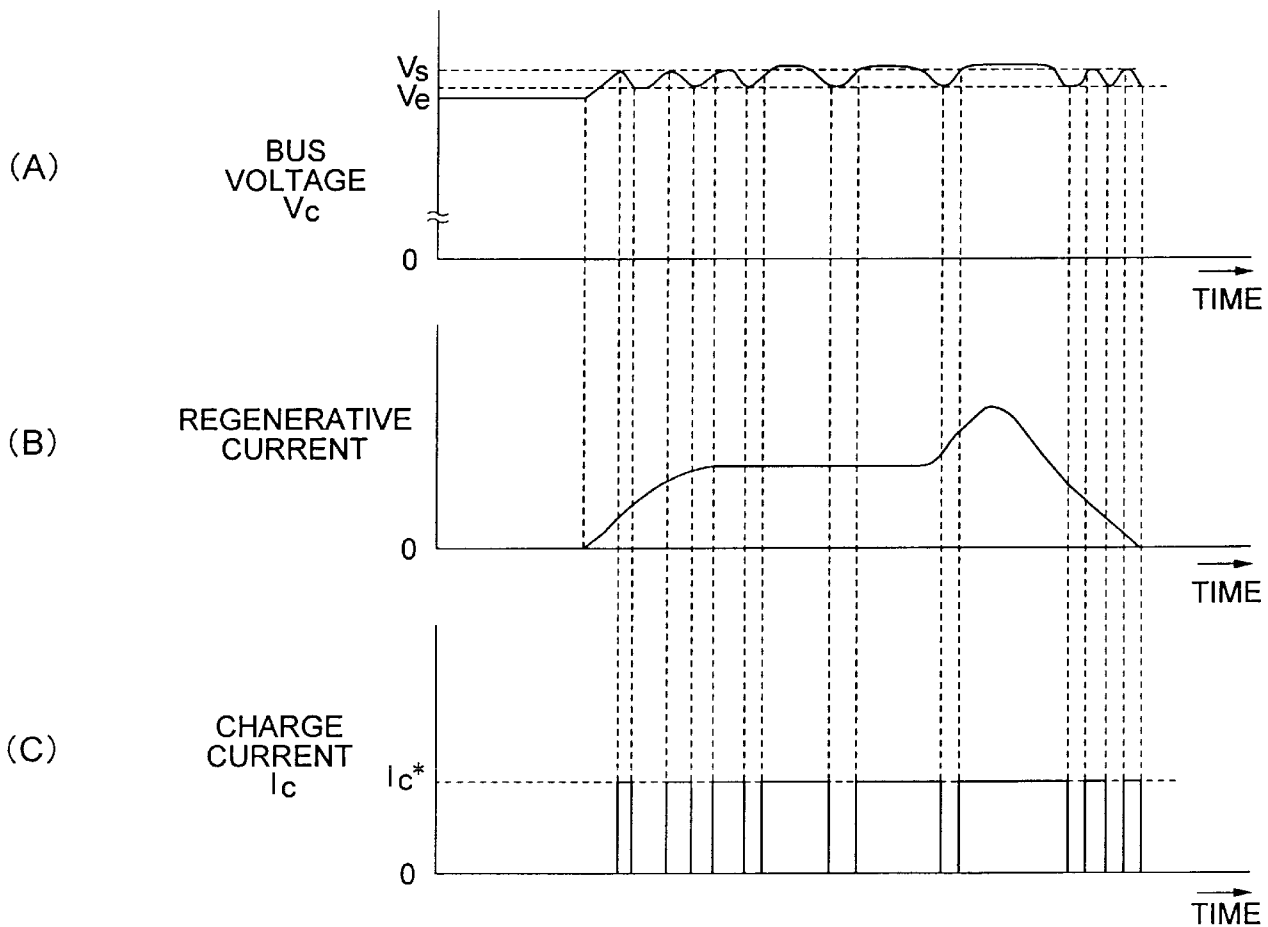
FIGS. 11(A)–11(C) are timing charts illustrating an operation of an elevator control apparatus according to a fifth embodiment of the present invention.

An operation of the fifth embodiment will now be described. FIGS. 11(A)–11(C) show waveforms related to the elevator control apparatus according to the fifth embodiment of the present invention, wherein FIG. 11(A) shows a bus voltage waveform, FIG. 11(B) shows a waveform of a regenerative current from a motor 2, and FIG. 11(C) shows a waveform of charge current supplied to the power storage unit 21.

When the regenerative operation of the elevator begins, the capacitor 10 shown in FIG. 1 is charged, and the bus voltage increases. As shown in FIG. 11(A), when a bus voltage Vs preset at a voltage higher than a voltage obtained by rectifying and smoothing a supply voltage is reached, charging the power storage unit 21 with regenerative electric power at a constant current is started according to a charge current command value Ic*.

Then, as shown in FIG. 11(A), when a preset bus voltage Ve (Ve<Vs) is reached, the charging of the power storage unit 21 is stopped as illustrated in FIG. 11(C). Thus, the power storage unit 21 can be charged based on regenerative current by changing the time for supplying the charge current.

Sixth Embodiment

An elevator control apparatus according to a sixth embodiment of the present invention will be described with reference to the accompanying drawings. The basic construction of the elevator control apparatus according to the sixth embodiment is identical to the construction of the foregoing first embodiment.

In the fourth and fifth embodiments described above, charging is performed at one preset constant current. In the sixth embodiment, a charge current value is changed in steps based on a bus voltage to provide substantially the same advantages as those of the fifth embodiment.

Figure 12:
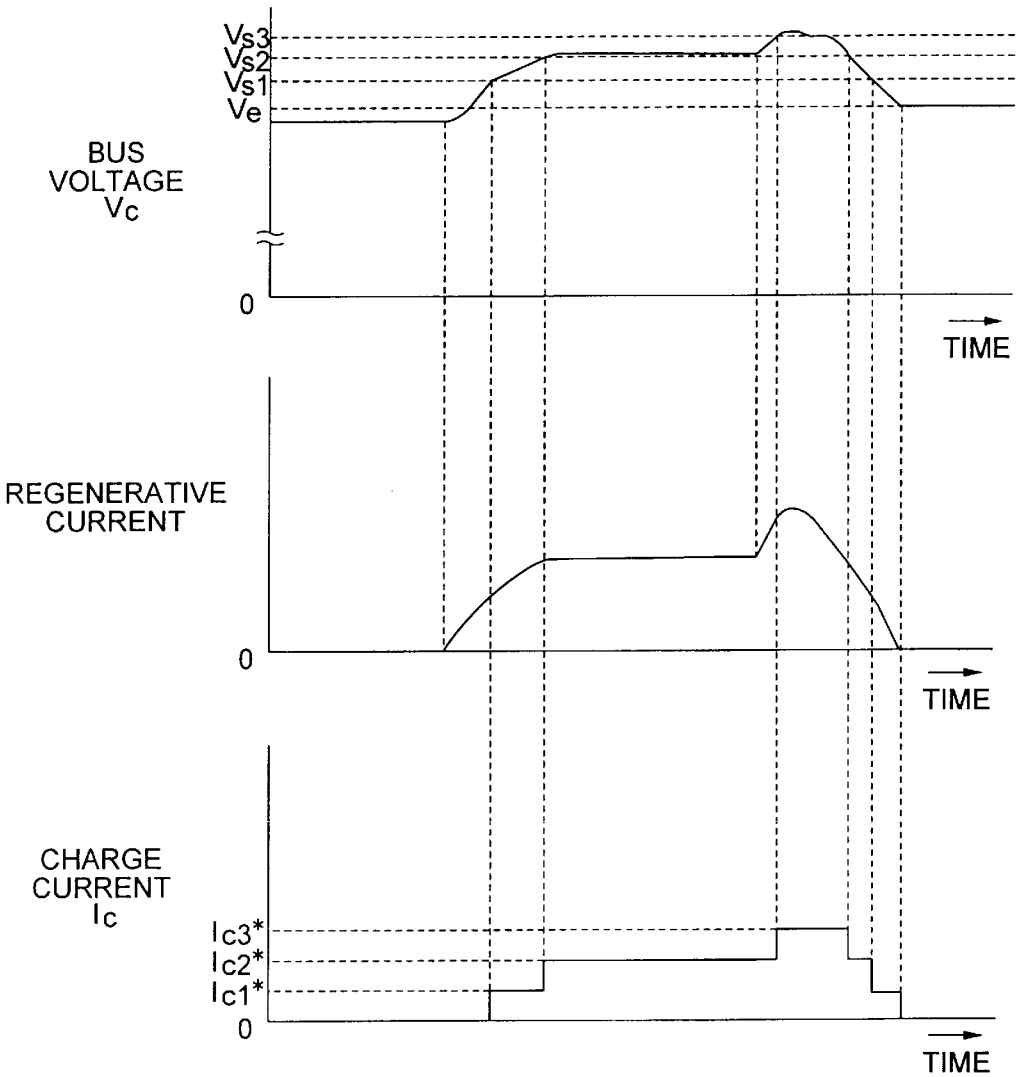
FIGS. 12(A)–12(C) are timing charts illustrating an operation of an elevator control apparatus according to a sixth embodiment of the present invention.

An operation of the sixth embodiment will now be described. FIGS. 12(A)–12(C) show waveforms related to the elevator control apparatus according to the sixth embodiment of the present invention, wherein FIG. 12(A) shows a bus voltage waveform, FIG. 12(B) shows a waveform of a regenerative current from a motor 2, and FIG. 12(C) shows a waveform of charge current supplied to the power storage unit 21.

When the regenerative operation of the elevator begins, the capacitor 10 shown in FIG. 1 is charged, and the bus voltage increases. As shown in FIG. 12(A), when a first preset bus voltage Vs1 that is higher than a voltage obtained by rectifying and smoothing a supply voltage is reached, charging the power storage unit 21 with regenerative electric power at a constant current is started according to a first charge current command value Ic1*.

Then, as shown in FIG. 12(A), when a second preset bus voltage Vs2 (Vs2>Vs1) is reached, charging the power storage unit 21 with regenerative electric power at a constant current is performed according to a second charge current command value Ic2*. Furthermore, when a third preset but voltage Vs3 (Vs3>Vs2) is reached, charging the power storage unit 21 with regenerative electric power at a constant current is performed according to a third charge current command value Ic3*.

If the bus voltage decreases to the second bus voltage Vs2 or the first bus voltage Vs1, then the charge current command value is changed accordingly. Some hysteresis voltage may be provided for a switching voltage between an increasing bus voltage and a decreasing bus voltage. When the bus voltage reaches Ve (Vs1>Ve), the charging control of the charge circuit is stopped.

Although the sixth embodiment has referred to a case where the three-step switching system is used, any number of steps may be used as long as there are two steps or more.

Alternatively, the charging control may be started upon receipt of an elevator regenerative operation signal, and the charging control may be stopped upon receipt of an elevator stop signal.

Seventh Embodiment

An elevator control apparatus according to a seventh embodiment of the present invention will be described with reference to the accompanying drawings. The basic construction of the elevator control apparatus according to the seventh embodiment is identical to the construction of the foregoing first embodiment.

In the third embodiment described above, no upper limit value is provided for the charge current of the power storage unit 21. In the seventh embodiment, the charge current is furnished with an upper limit value. The seventh embodiment is able to provide the same advantages as those of the above third embodiment and also to prevent a sudden increase in a battery voltage attributable to large-current charging in the vicinity of a peak of regenerative electric power taking place before an elevator is stopped when the power storage unit 21 employs a battery, and further to prevent a gas from being produced in the battery, thus protecting the battery from rapid deterioration.

Figure 13:
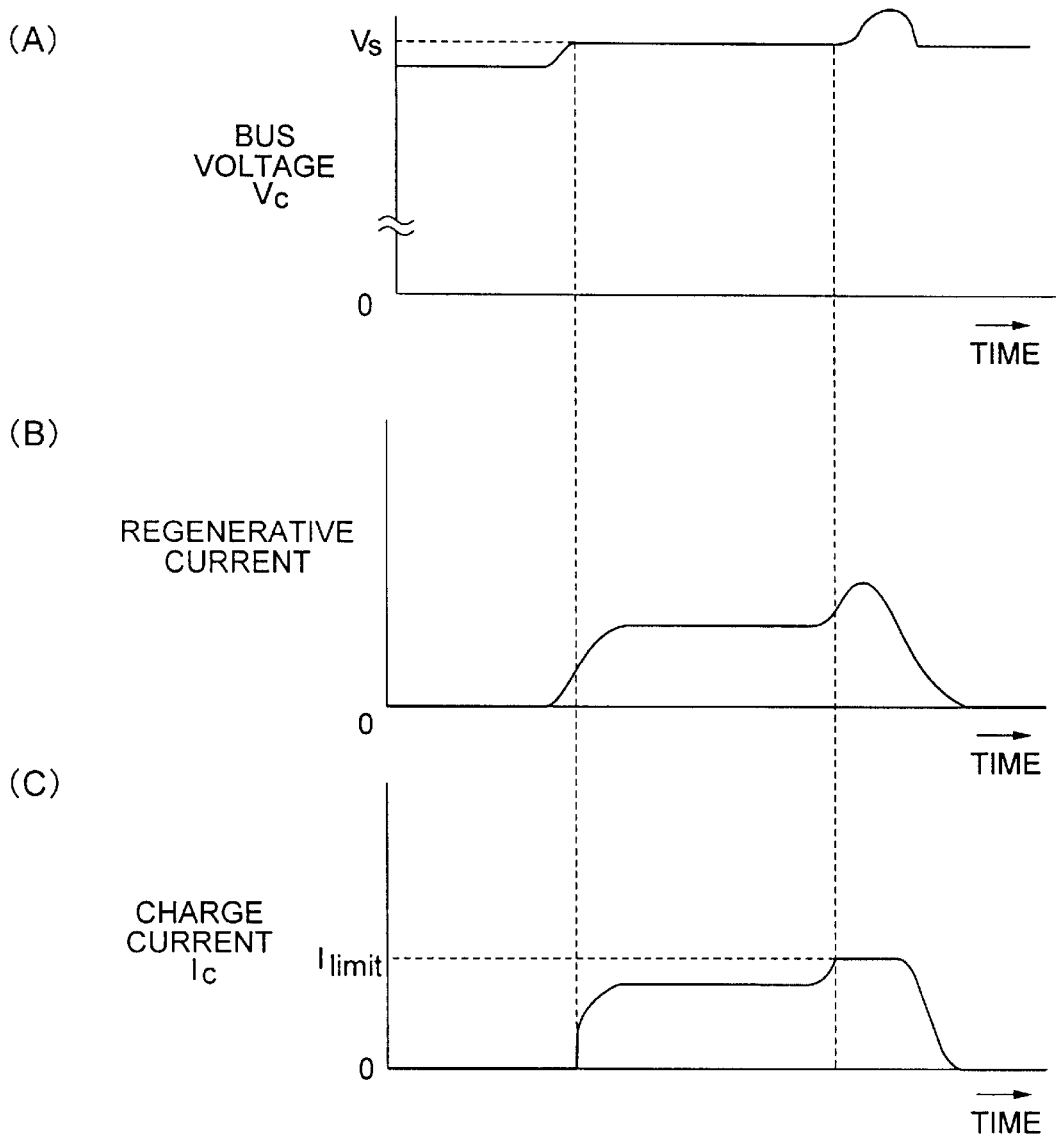
FIGS. 13(A)–13(C) are timing charts illustrating an operation of an elevator control apparatus according to a seventh embodiment of the present invention.

An operation of the seventh embodiment will now be described. FIGS. 13(A)–13(C) show waveforms related to the elevator control apparatus according to the seventh embodiment of the present invention, wherein FIG. 13(A) shows a bus voltage waveform, FIG. 13(B) shows a waveform of a regenerative current from a motor 2, and FIG. 13(C) shows a waveform of charge current supplied to the power storage unit 21.

When the regenerative operation of the elevator begins, the capacitor 10 shown in FIG. 1 is charged, and the bus voltage increases. When a preset bus voltage Vs that is higher than a voltage obtained by rectifying and smoothing a supply voltage is reached as shown in FIG. 13(A), control of charging the power storage unit 21 with regenerative electric power is started as shown in FIG. 13(C).

A charging power control circuit in a charge/discharge control circuit 23A controls a voltage to a constant voltage by a voltage controller 57 based on a predetermined voltage command (the same voltage as the voltage Vs at which the charging control is started in this embodiment), and the charge current is controlled by a charge current controller 54 as shown in FIG. 6, thereby precisely charging the power storage unit 21 with regenerative electric power.

An upper limit value $I_{limit}$ is preset at a charge current value that is lower than a charge current at which the voltage of the power storage unit 21 suddenly increases or a gas is produced therein. When the charge current reaches the upper limit value $I_{limit}$ as shown in FIG. 13(C), charging is carried out at that upper limit value. The charging control by the charge/discharge control circuit 23A is stopped after the moment a charge current detected by a current detector 24 shown in FIG. 1 reaches zero.

Alternatively, the charging control may be started upon receipt of an elevator regenerative operation signal, and the charging control may be stopped upon receipt of an elevator stop signal.

Eighth Embodiment

Figure 14:
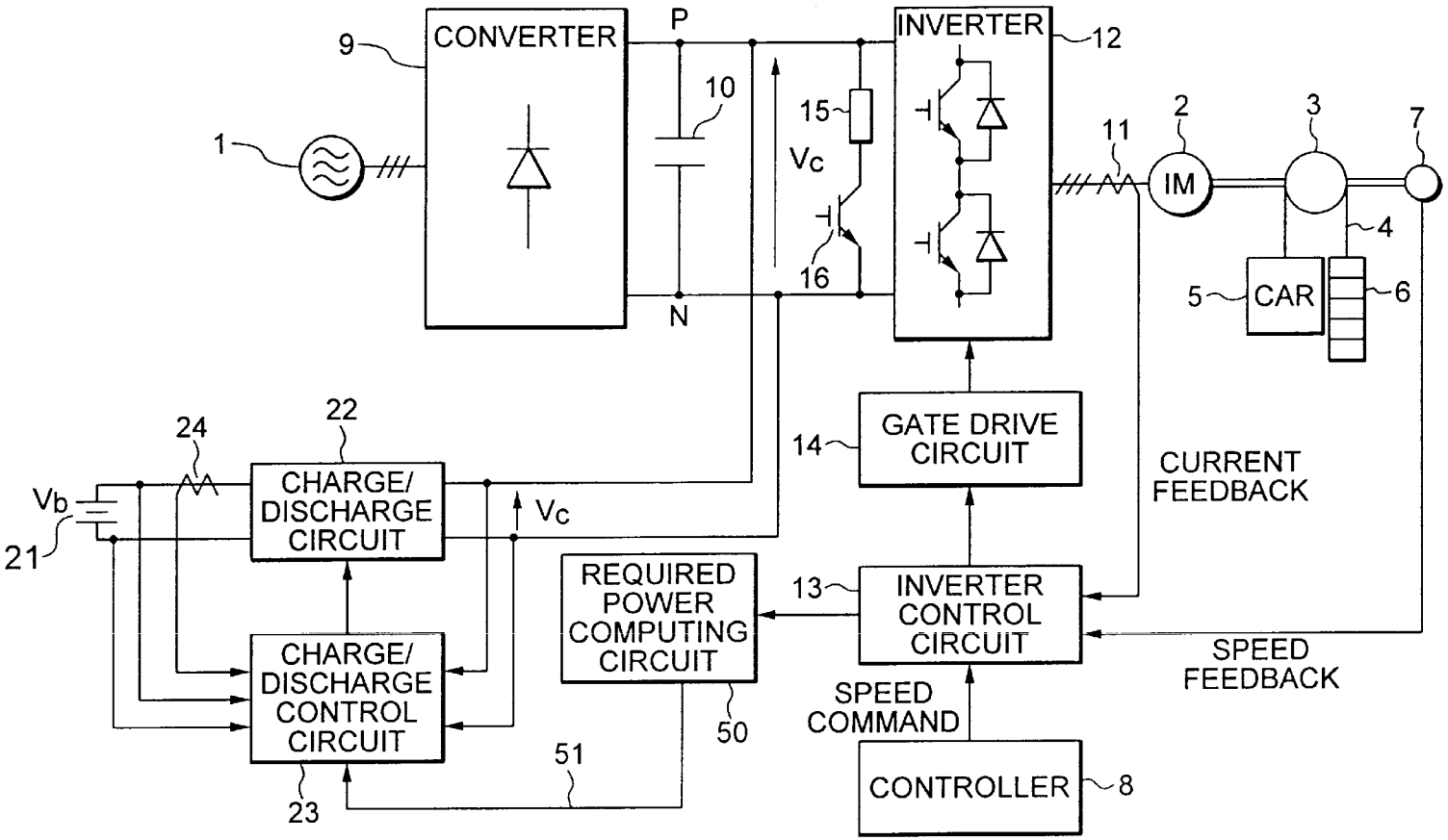
FIG. 14 is a diagram showing a construction of an elevator control apparatus according to an eighth embodiment of the present invention.

An elevator control apparatus according to an eighth embodiment of the present invention will be described in conjunction with the accompanying drawings. FIG. 14 shows a construction of the elevator control apparatus according to the eighth embodiment of the present invention.

Referring to FIG. 14, reference numeral 15 denotes a resistor, and reference numeral 16 denotes a switching means, such as an IGBT. The rest of the components are equivalent to the components of FIG. 1 mentioned in the first embodiment described above.

In the above seventh embodiment, the charge current of the power storage unit 21 is provided with an upper limit value. In the eighth embodiment, the charge current is furnished with an upper limit value, and when the charge current supplied to the power storage unit 21 reaches a predetermined upper limit value, if a bus voltage exceeds a second predetermined voltage, then a part of regenerative electric power is thermally consumed by the resistor 15 while continuing charging the power storage unit 21 at the upper limit current value. With this arrangement, the same advantages as those of the above seventh embodiment can be obtained, and an increase in the bus voltage can be restrained, thus protecting an inverter circuit 12 from an overvoltage.

Figure 15:
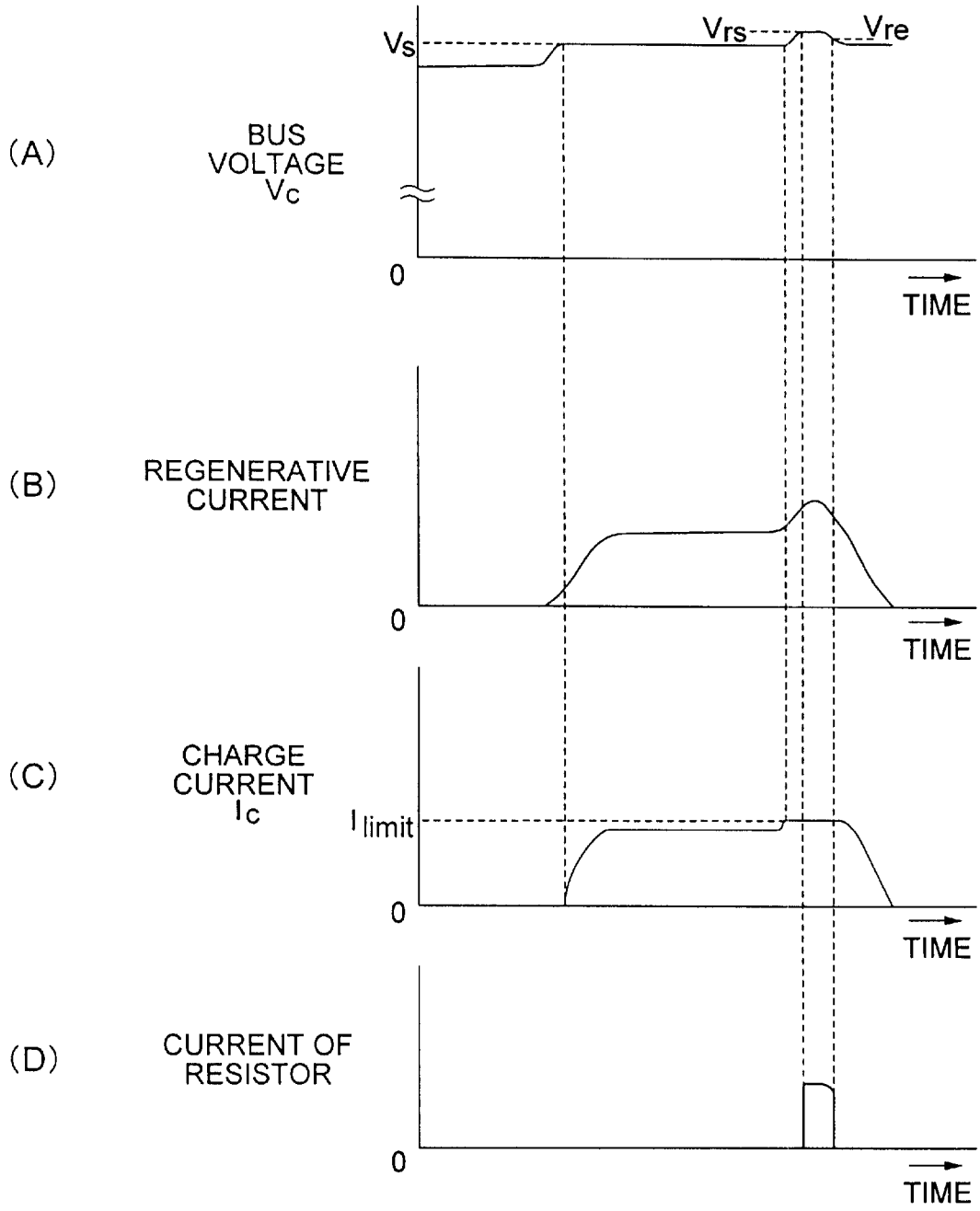
FIGS. 15(A)–15(D) are timing charts illustrating an operation of the elevator control apparatus according to the eighth embodiment of the present invention.

An operation of the eighth embodiment will now be described. FIG. 15(A) shows a bus voltage waveform, FIG. 15(B) shows a waveform of a regenerative current from a motor 2, FIG. 15(C) shows a waveform of charge current supplied to the power storage unit 21, FIG. 15(D) shows a waveform of the resistor 15.

The eighth embodiment performs the same basic operation as the seventh embodiment described above, but differs therefrom in that, when the charge current supplied to the power storage unit 21 reaches a predetermined upper limit value $I_{limit}$, if the bus voltage exceeds a second predetermined voltage Vrs as shown in FIG. 15(A), then a charge/discharge control circuit 23 sends a signal to that effect to a controller 8 via a communication cable (not shown) while continuing charging the power storage unit 21 at the upper limit value $I_{limit}$, and turns a switching means 16 On by a control signal from the controller 8 to pass current through the resistor 15 as illustrated in FIG. 15(D) so as to thermally consume a part of regenerative electric power. This restrains a sudden increase in the bus voltage. When the bus voltage reaches a third predetermined voltage Vre of less, the switching means 16 is turned OFF. Alternatively, the switching means 16 may be turned ON or driven directly by the charge/discharge control circuit 23.

Ninth Embodiment

An elevator control apparatus according to a ninth embodiment of the present invention will be described with reference to the accompanying drawings. The basic construction of the elevator control apparatus according to the ninth embodiment is the same as that of the first embodiment.

In the seventh embodiment, the charge current is provided with an upper limit value for the purpose of preventing a sudden increase in a battery voltage attributable to large-current charging in the vicinity of a peak of regenerative electric power taking place before an elevator is stopped when the power storage unit 21 employs a battery, and also preventing a gas from being produced in the battery, thus protecting the battery from rapid deterioration. For attaining the same purpose mentioned above, the ninth embodiment is adapted to stop charging the power storage unit 21 when the voltage of the power storage unit 21 reaches a preset upper limit voltage. The ninth embodiment provides the same advantages as those of the seventh embodiment.

Figure 16:
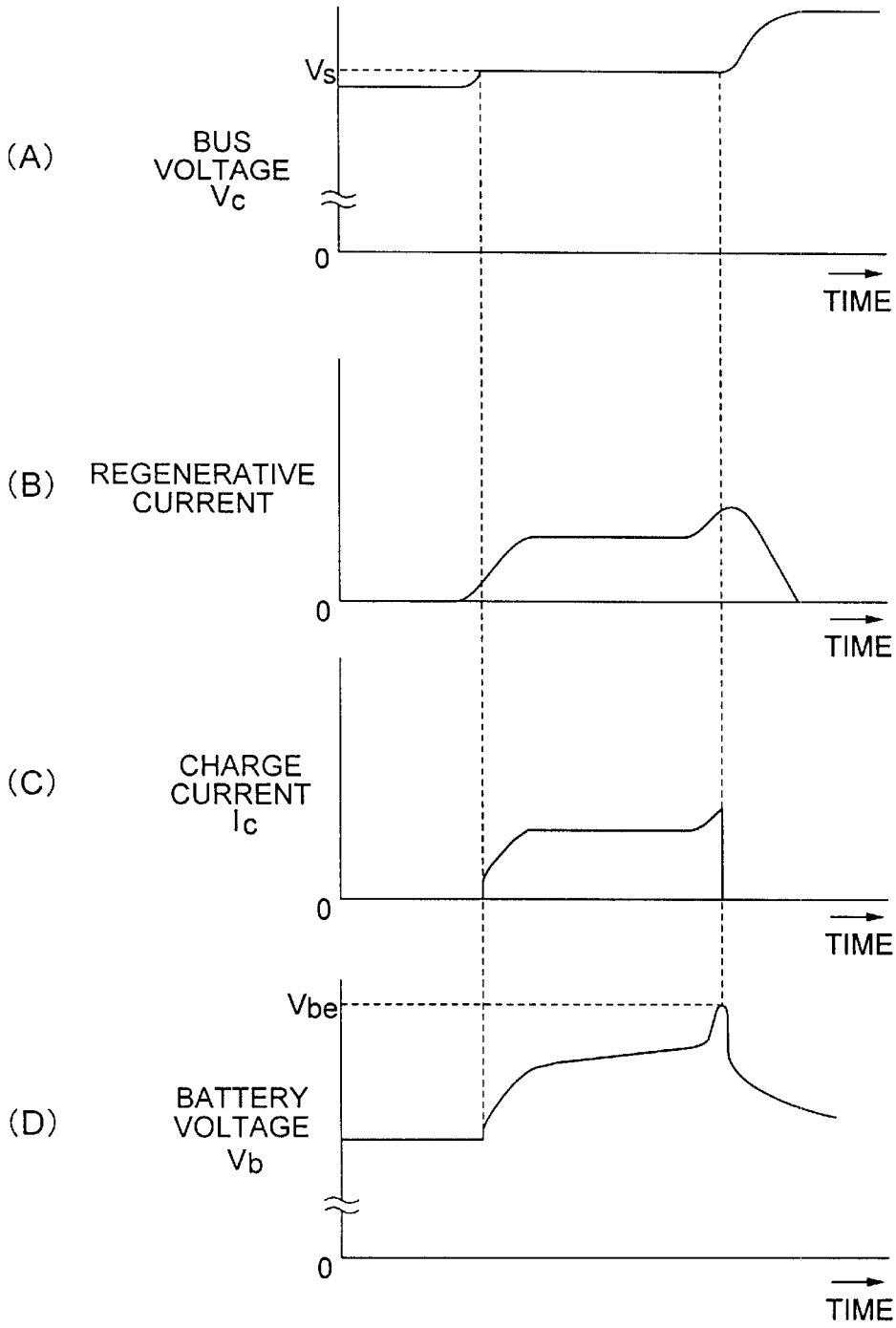
FIGS. 16(A)–16(D) are timing charts illustrating an operation of the elevator control apparatus according to a ninth embodiment of the present invention.

An operation of the ninth embodiment will now be described. FIGS. 16(A)–16(D) show waveforms related to the elevator control apparatus according to the ninth embodiment of the present invention, wherein FIG. 16(A) shows a bus voltage waveform, FIG. 16(B) shows a waveform of a regenerative current from a motor 2, FIG. 16(C) shows a waveform of charge current supplied to the power storage unit 21, and FIG. 16(D) shows a voltage waveform of the power storage unit 21.

The ninth embodiment performs the same basic operation as the third embodiment described above, but differs therefrom in that, when the voltage of the power storage unit 21 reaches a preset upper voltage Vbe as shown in FIG. 16(D), charging the power storage unit 21 is stopped as shown in FIG. 16(C).

Tenth Embodiment

An elevator control apparatus according to a tenth embodiment of the present invention will be described with reference to the accompanying drawings. The basic construction of the elevator control apparatus according to the tenth embodiment is the same as that of the first embodiment.

In the ninth embodiment described above, the charging of the power storage unit 21 is stopped when the voltage of the power storage unit 21 reaches the preset upper limit voltage.

In the tenth embodiment, when the voltage of the power storage unit 21 reaches a preset voltage, charging is continued, with an upper limit value being provided for the charge current supplied to the power storage unit 21. This arrangement provides the same advantages as those of the ninth embodiment described above, and also permits further energy saving because charging the power storage unit 21 can be continued with regenerative electric power at a lower rate of charge current.

Figure 17:
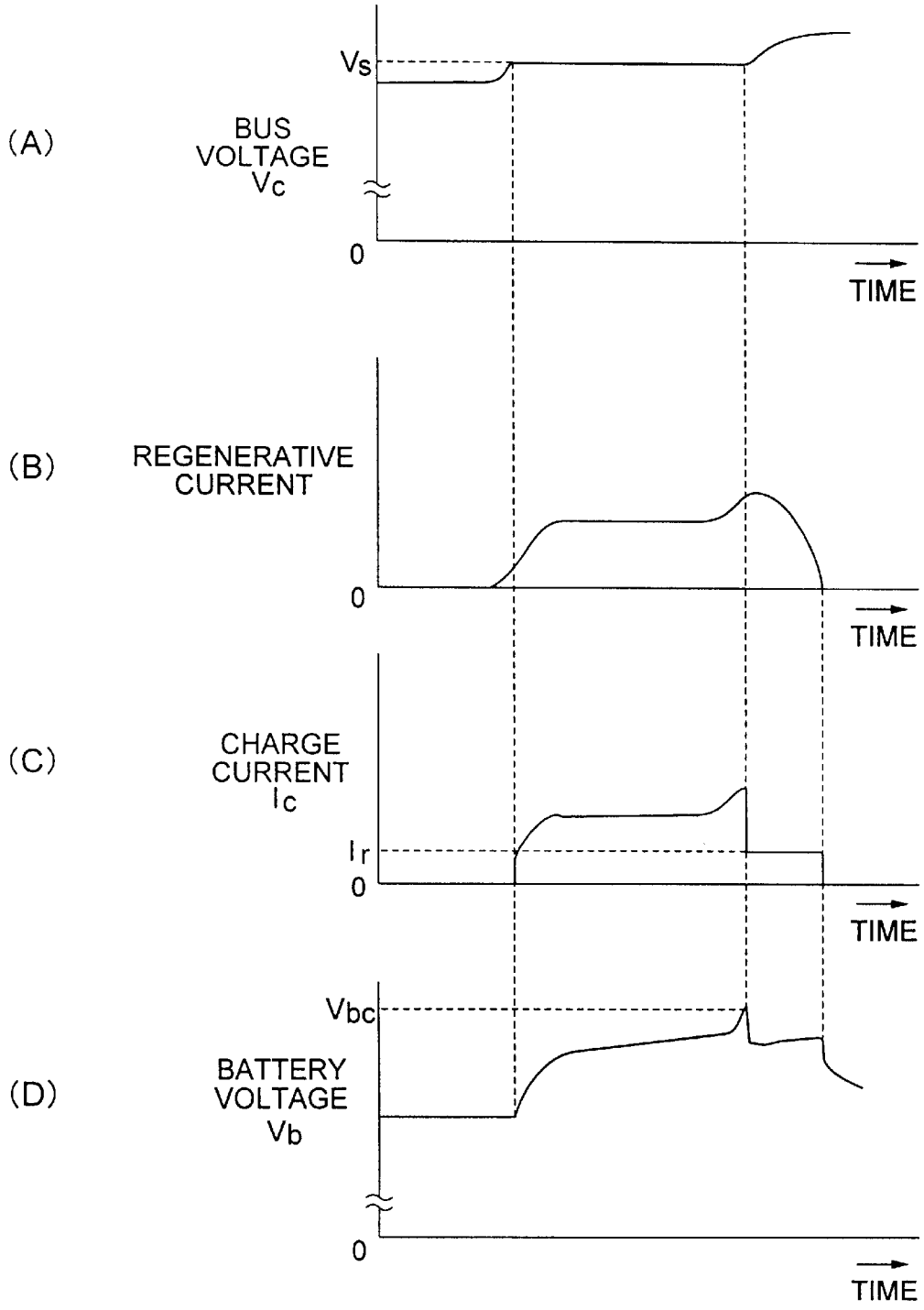
FIGS. 17(A)–17(D) are timing charts illustrating an operation of the elevator control apparatus according to a tenth embodiment of the present invention.

An operation of the tenth embodiment will now be described. FIGS. 17(A)–17(D) show waveforms related to the elevator control apparatus according to the tenth embodiment of the present invention, wherein FIG. 17(A) shows a bus voltage waveform, FIG. 17(B) shows a waveform of a regenerative current from a motor 2, FIG. 17(C) shows a waveform of charge current supplied to the power storage unit 21, and FIG. 17(D) shows a voltage waveform of the power storage unit 21.

The tenth embodiment performs the same basic operation as the ninth embodiment described above, but differs therefrom in that, when the voltage of the power storage unit 21 reaches a preset voltage Vbc as illustrated in FIG. 17(D), the charging is continued, providing an upper limit value Ir at a lower rate for the charge current supplied to the power storage unit 21 as illustrated in FIG. 17(C) so as to charge the power storage unit 21 with regenerative electric power as much as possible.

As in the case of the fifth embodiment described above, the upper limit value Ir of the charge current may take two values, namely, Ir and zero, according to the bus voltage or the voltage of the power storage unit 21. Further alternatively, the upper limit value Ir of the charge current may change in steps according to the bus voltage or the voltage of the power storage unit 21, as in the case of the sixth embodiment.

Eleventh Embodiment

An elevator control apparatus according to an eleventh embodiment of the present invention will be described with reference to the accompanying drawings. The basic construction of the elevator control apparatus according to the eleventh embodiment is the same as that of the eighth embodiment.

In the above tenth embodiment, the charge current of the power storage unit 21 is provided with an upper limit value when the voltage of the power storage unit 21 reaches a preset voltage. In the eleventh embodiment, the charge current is furnished with an upper limit value, and when the charge current supplied to the power storage unit 21 reaches a predetermined upper limit value, if a bus voltage exceeds a second predetermined voltage, then a part of regenerative electric power is thermally consumed by a resistor 15 while continuing charging the power storage unit 21 at the upper limit current value. With this arrangement, the same advantages as those of the above tenth embodiment can be obtained, and an increase in the bus voltage can be restrained, thus protecting an inverter circuit 12 from an overvoltage.

Figure 18:
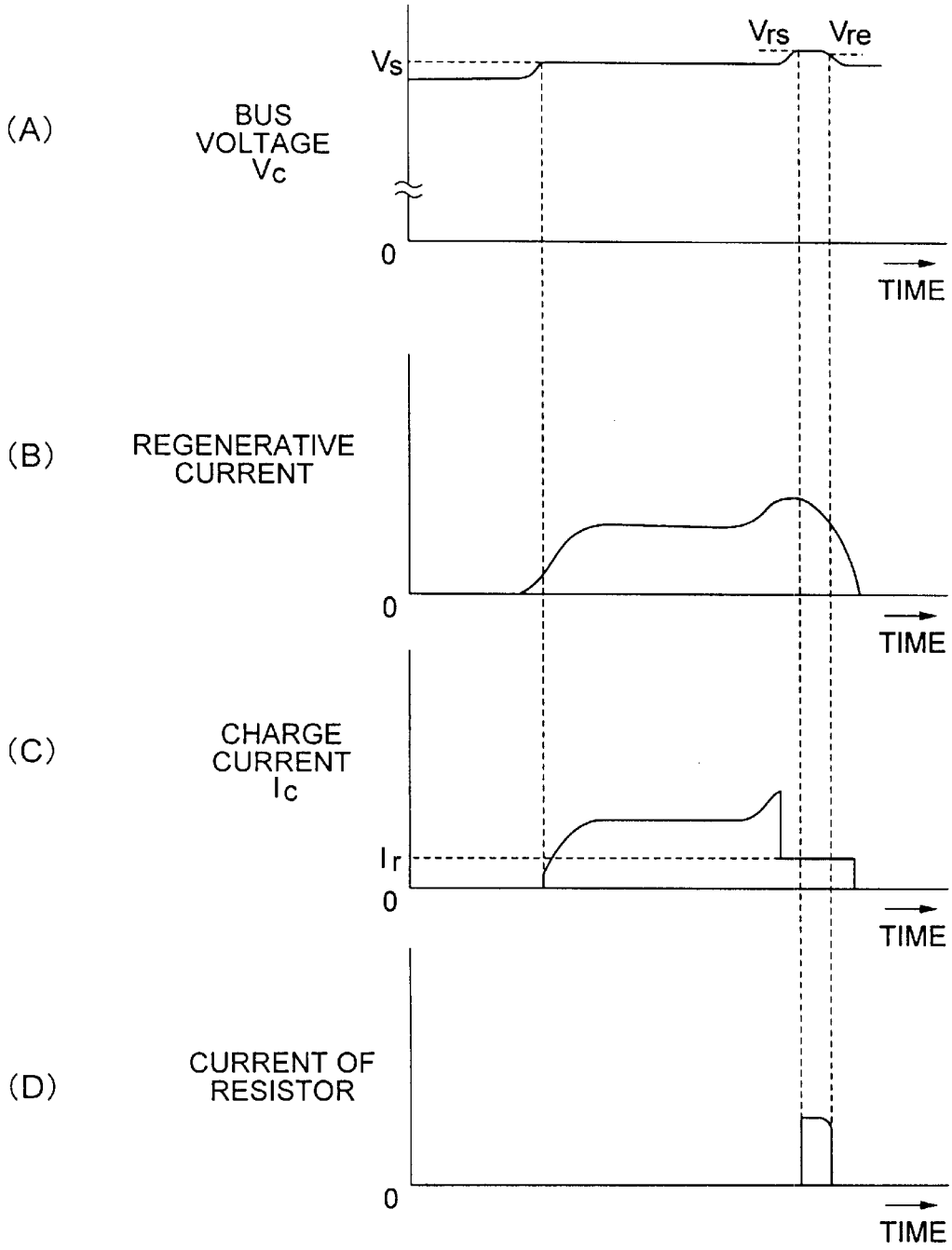
FIGS. 18(A)–18(D) are timing charts illustrating an operation of the elevator control apparatus according to an eleventh embodiment of the present invention.

An operation of the eleventh embodiment will now be described. FIGS. 18(A)–18(D) show waveforms related to the elevator control apparatus according to the eleventh embodiment of the present invention, wherein FIG. 18(A) shows a bus voltage waveform, FIG. 18(B) shows a waveform of a regenerative current from a motor 2, FIG. 18(C) shows a waveform of charge current supplied to the power storage unit 21, and FIG. 18(D) shows a waveform of the resistor 15.

The eleventh embodiment performs the same basic operation as the tenth embodiment described above, but differs therefrom in that, after the voltage of the power storage unit 21 reaches a predetermined voltage Vs, if the bus voltage exceeds a second predetermined voltage Vrs as shown in FIG. 18(A), then a switching means 16 is turned ON to pass current through the resistor 15 as illustrated in FIG. 18(D) so as to thermally consume a part of regenerative electric power while continuing charging the power storage unit 21 at the upper limit current value Ir. This restrains a sudden increase in the bus voltage. When the bus voltage reaches a third predetermined voltage Vre or less, the switching means 16 is turned OFF.

What is claimed is:

1. An elevator control apparatus comprising:

a converter for rectifying AC power to produce DC power;

an inverter for converting DC power into AC power having a variable voltage and a variable frequency;

DC buses connecting the converter to the inverter;

a power storage unit connected across the DC buses for storing DC power and for supplying DC power to the buses;

a controller for controlling a motor operating an elevator, the motor being driven by the AC power having variable voltage and variable frequency, during a powered operation of the elevator and generating power during a regenerative operation of the elevator;

a required power computing circuit for computing required power as power required by the elevator based on a speed command for controlling speed of the elevator and supplied to the controller and, through the controller, to the required power computing circuit;

a charge/discharge control circuit maintaining a bus voltage across the buses, at a preset voltage, not less than a voltage obtained by rectifying the AC power, receiving the bus voltage as a feedback input and receiving the required power computed as another input, and issuing a drive signal for charging the power storage unit with regenerative electric power if the power required by the elevator is negative, meaning regenerative electric power is being generated by the motor; and a charge/discharge circuit for charging the power storage unit with the regenerative electric power in accordance with the drive signal.

2. An elevator control apparatus comprising:

a converter for rectifying AC power to produce DC power;

an inverter for covering DC power into AC power having a variable voltage and a variable frequency;

DC buses connecting the converter to the inverter;

a power storage unit connected across the DC buses for storing DC power and for supplying DC power to the buses;

a controller for controlling a motor operating an elevator, the motor being driven by the AC power having variable voltage and variable frequency, during a powered operation of the elevator and generating power during a regenerative operation of the elevator;

a current sensor for sensing charging current being supplied to the power storage unit;

a charge/discharge control circuit maintaining a bus voltage between the converter and the inverter at a preset voltage, not less than a voltage obtained by rectifying the AC power, monitoring the charging current supplied to the power storage unit from the regenerative electric power generated by the motor with the current sensor, and issuing a drive signal stopping charging of the power storage unit with the regenerative electric power when the charging current reaches zero; and a charge/discharge circuit stopping charging of the power storage unit with the regenerative electric power in accordance with the drive signal.

3. An elevator control apparatus comprising:

a converter for rectifying AC power to produce DC power;

an inverter for converting DC power into AC power having a variable voltage and a variable frequency;

DC buses connecting the converter to the inverter;

a power storage unit connected across the DC buses for storing DC power and for supplying DC power to the buses;

a controller for controlling a motor operating an elevator, the motor being driven by the AC power having variable voltage and variable frequency, during a powered operation of the elevator and generating power during a regenerative operation of the elevator;

a current sensor for sensing charging current being supplied to the power storage unit and a voltage sensor for sensing the voltage of the power storage unit;

a charge/discharge control circuit maintaining the bus voltage at a preset voltage, receiving the charging current and voltage sensed as inputs, issuing a drive signal for charging the power storage unit with regenerative electric power generated by the motor, controlling the charging current supplied to the power storage unit so the charging current may reach, but not exceed, an upper limit value, and issuing a drive signal for continuing charging of the power storage unit with regenerative electric power at a constant current less than the upper limit value after the voltage of the power storage unit reaches a preset voltage, whereby power storage by the power storage unit is maximized; and a charge/discharge circuit for charging the power storage unit with the regenerative electric power in accordance with the drive signal produced by the charge/discharge control circuit.

4. The elevator control apparatus according to claim 3, wherein, when the voltage of the power storage unit reaches the preset voltage and the bus voltage exceeds a preset second voltage while the power storage unit is being charged at a charging current at the upper limit value, the charge/discharge control circuit diverts some of the regenerative electric power to a resistor.

* * * * *